US006439677B1

(12) United States Patent
Kanaya et al.

(10) Patent No.: US 6,439,677 B1
(45) Date of Patent: Aug. 27, 2002

(54) PRINTER AND PRINTING THEREFOR

(75) Inventors: Munehide Kanaya; Kazumichi Shimada, both of Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/147,554

(22) PCT Filed: May 20, 1998

(86) PCT No.: PCT/JP98/02216

§ 371 (c)(1),
(2), (4) Date: Jan. 20, 1999

(87) PCT Pub. No.: WO98/52761

PCT Pub. Date: Nov. 26, 1998

(30) Foreign Application Priority Data

May 20, 1997 (JP) ..... 9-130100

(51) Int. Cl.[7] ..... B41J 29/38; B41J 2/205; B41J 2/145; B41J 2/15

(52) U.S. Cl. ..... 347/9; 347/15; 347/41

(58) Field of Search ..... 347/9, 41, 15, 347/40

(56) References Cited

U.S. PATENT DOCUMENTS 5,831,642 A * 11/1998 Matsubara et al. ..... 347/9
5,844,585 A * 12/1998 Kurashima et al. ..... 347/43
5,946,011 A * 8/1999 Kemya ..... 347/41
5,988,790 A * 11/1999 Koike et al. ..... 347/41

FOREIGN PATENT DOCUMENTS

JP 06047925 A * 2/1994 ..... B41J/2/21

* cited by examiner

*Primary Examiner*—John Barlow
*Assistant Examiner*—Alfred Dudding
(74) *Attorney, Agent, or Firm*—Oblon, Spivak, McClelland, Maier & Neustadt, P.C.

(57) ABSTRACT

A printing apparatus which avoids the occurrence of banding due to errors of sheet feeding. The apparatus includes a print head with a nozzle array including a plurality of nozzles, a main scan driving unit, a print head driving unit that drives nozzles selected from the array, a sub-scan driving unit that drives the print medium in the sub-scanning direction and a control unit. The control unit controls the main scan driving unit, the sub-scan driving unit and the print head driving unit and also carries out printing on the print medium with the print head. The control procedure of the control unit causes each of the nozzles which are not used in the process of constant pitch sub-scan printing or overlap printing, to create a dot adjoining two dots, where banding is often observed.

8 Claims, 16 Drawing Sheets

Fig. 12(A) Principle of Sub-scan Feed

Fig. 12(B) Parameters
Number of Nozzles N:3
Number of Selected Nozzles n:2
Number of Unselected Nozzles :1
Nozzle Interval k:1 (dot pitch)

Fig. 12(C) State of Working Nozzles

Main scanning direction →

Sub-scanning ↓ direction

| | | | | |
|---|---|---|---|---|
| 1 − 1 | | | | |
| 1 − 2 | | | | |
| 1 − 3 | 2 − 1 | | | |
| | 2 − 2 | | | |
| | 2 − 3 | 3 − 1 | | |
| | | 3 − 2 | | |
| | | 3 − 3 | 4 − 1 | |
| | | | 4 − 2 | |
| | | | 4 − 3 | 5 − 1 |
| | | | | 5 − 2 |

Fig. 13

| Step 1 | | Step 2 | | Step3 | |
|---|---|---|---|---|---|
| 1−1 | | 1−1 | | 1−1 | |
| 1−2 | 1−2 | 1−2 | 1−2 | 1−2 | 1−2 |
| 1−3 | 2−1 | 1−3 | 2−1 | 1−3 | 2−1 |
| 2−2 | 2−2 | 2−2 | 2−2 | 2−2 | 2−2 |
| 3−1 | 2−3 | 3−1 | 2−3 | 3−1 | 2−3 |
| 3−2 | 3−2 | 3−2 | 3−2 | 3−2 | 3−2 |
| 3−3 | 4−1 | 3−3 | 4−1 | 3−3 | 4−1 |
| 4−2 | 4−2 | 4−2 | 4−2 | 4−2 | 4−2 |
| 5−1 | 4−3 | 5−1 | 4−3 | 5−1 | 4−3 |
| 5−2 | 5−2 | 5−2 | 5−2 | 5−2 | 5−2 |
| 5−3 | 6−1 | 5−3 | 6−1 | 5−3 | 6−1 |
| 6−2 | 6−2 | 6−2 | 6−2 | 6−2 | 6−2 |
| | 6−3 | | 6−3 | | 6−3 |

Fig. 15

| Step 1 | | | Step 2 | | |
|---|---|---|---|---|---|
| 1 -1 | | | 1 -1 | | |
| | | | | | |
| | 2 -1 | | | 2 -1 | |
| 1 -2 | | 1 -2 | | 1 -2 | |
| | | 3 -1 | | | 3 -1 |
| | 2 -2 | | 2 -2 | | 2 -2 |
| 4 -1 | 1 -3 | | 4 -1 | 1 -3 | |
| 3 -2 | | 3 -2 | | 3 -2 | |
| | 5 -1 | 2 -3 | | 5 -1 | 2 -3 |
| 1 -4 | 4 -2 | 1 -4 | 4 -2 | 1 -4 | 4 -2 |
| 3 -3 | | 6 -1 | 3 -3 | | 6 -1 |
| 5 -2 | 2 -4 | 5 -2 | 2 -4 | 5 -2 | 2 -4 |
| 7 -1 | 4 -3 | 1 -5 | 7 -1 | 4 -3 | 1 -5 |
| 3 -4 | 6 -2 | 3 -4 | 6 -2 | 3 -4 | 6 -2 |
| 2 -5 | 8 -1 | 5 -3 | 2 -5 | 8 -1 | 5 -3 |
| 7 -2 | 4 -4 | 7 -2 | 4 -4 | 7 -2 | 4 -4 |
| 6 -3 | 3 -5 | 9 -1 | 6 -3 | 3 -5 | 9 -1 |
| 5 -4 | 8 -2 | 5 -4 | 8 -2 | 5 -4 | 8 -2 |
| 10- 1 | 7 -3 | 4 -5 | 10- 1 | 7 -3 | 4 -5 |
| 9 -2 | 6 -4 | 9 -2 | 6 -4 | 9 -2 | 6 -4 |
| 5 -5 | 11- 1 | 8 -3 | 5 -5 | 11- 1 | 8 -3 |
| 7 -4 | 10- 2 | 7 -4 | 10- 2 | 7 -4 | 10- 2 |
| 9 -3 | 6 - 5 | 12- 1 | 9 -3 | 6 - 5 | 12- 1 |
| 11- 2 | 8 - 4 | 11- 2 | 8 - 4 | 11- 2 | 8 - 4 |
| | 10- 3 | 7 -5 | | 10- 3 | 7 -5 |
| 9 -4 | 12- 2 | 9 -4 | 12- 2 | 9 -4 | 12- 2 |
| 8 -5 | | 11- 3 | 8 -5 | | 11- 3 |
| | 10- 4 | | 10- 4 | | 10- 4 |
| 12- 3 | 9 - 5 | | 12- 3 | 9 - 5 | |
| 11- 4 | | 11- 4 | | 11- 4 | |
| | | 10- 5 | | | 10- 5 |
| | 12- 4 | | 12- 4 | | 12- 4 |
| 11- 5 | | | 11- 5 | | |
| | | | | | |
| | 12- 5 | | | 12- 5 | |

Fig. 16

Main scanning direction

Sub-scanning direction

| | | | | | | | | | | | |
|---|---|---|---|---|---|---|---|---|---|---|---|
| 1-1 | | | | | | | | | | | |
| | | | | | | | | | | | |
| 1-2 | | | | | | | | | | | |
| | 2-1 | | | | | | | | | | |
| 1-3 | | | | | | | | | | | |
| | 2-2 | | | | | | | | | | |
| 1-4 | | 3-1 | | | | | | | | | |
| | 2-3 | | | | | | | | | | |
| 1-5 | | 3-2 | | | | | | | | | |
| | 2-4 | | 4-1 | | | | | | | | |
| 1-6 | | 3-3 | | | | | | | | | |
| | 2-5 | | 4-2 | | | | | | | | |
| 1-7 | | 3-4 | | 5-1 | | | | | | | |
| | 2-6 | | 4-3 | | | | | | | | |
| | | 3-5 | | 5-2 | | | | | | | |
| | 2-7 | | 4-4 | | 6-1 | | | | | | |
| | | 3-6 | | 5-3 | | | | | | | |
| | | | 4-5 | | 6-2 | | | | | | |
| | | 3-7 | | 5-4 | | 7-1 | | | | | |
| | | | 4-6 | | 6-3 | | | | | | |
| | | | | 5-5 | | 7-2 | | | | | |
| | | | 4-7 | | 6-4 | | 8-1 | | | | |
| | | | | 5-6 | | 7-3 | | | | | |
| | | | | | 6-5 | | 8-2 | | | | |
| | | | | 5-7 | | 7-4 | | 9-1 | | | |
| | | | | | 6-6 | | 8-3 | | | | |
| | | | | | | 7-5 | | 9-2 | | | |
| | | | | | 6-7 | | 8-4 | | 10-1 | | |
| | | | | | | 7-6 | | 9-3 | | | |
| | | | | | | | 8-5 | | 10-2 | | |
| | | | | | | 7-7 | | 9-4 | | 11-1 | |
| | | | | | | | 8-6 | | 10-3 | | |
| | | | | | | | | 9-5 | | 11-2 | |
| | | | | | | | 8-7 | | 10-4 | | 12-1 |
| | | | | | | | | 9-6 | | 11-3 | |
| | | | | | | | | | 10-5 | | 12-2 |
| | | | | | | | | 9-7 | | 11-4 | |
| | | | | | | | | | 10-6 | | 12-3 |
| | | | | | | | | | | 11-5 | |
| | | | | | | | | | 10-7 | | 12-4 |
| | | | | | | | | | | 11-6 | |
| | | | | | | | | | | | 12-5 |
| | | | | | | | | | | 11-7 | |
| | | | | | | | | | | | 12-6 |
| | | | | | | | | | | | |
| | | | | | | | | | | | 12-7 |
| Passes 1 | 2 | 3 | 4 | 5 | 6 | 7 | 8 | 9 | 10 | 11 | 12 |

Fig. 17

| Step 1 | | | Step 2 | | |
|---|---|---|---|---|---|
| 1-1 | | | 1-1 | | |
| | | | | | |
| 1-2 | | 1-2 | | 1-2 | |
| 2-1 | | | 2-1 | | |
| 1-3 | | 1-3 | | 1-3 | |
| 2-2 | | 2-2 | | 2-2 | |
| 1-4 | 3-1 | | 1-4 | 3-1 | |
| 2-3 | | 2-3 | | 2-3 | |
| 1-5 | 3-2 | 1-5 | 3-2 | 1-5 | 3-2 |
| 2-4 | 4-1 | | 2-4 | 4-1 | |
| 1-6 | 3-3 | 1-6 | 3-3 | 1-6 | 3-3 |
| 2-5 | 4-2 | 2-5 | 4-2 | 2-5 | 4-2 |
| 1-7 | 3-4 | 5-1 | 1-7 | 3-4 | 5-1 |
| 2-6 | 4-3 | 2-6 | 4-3 | 2-6 | 4-3 |
| 5-2 | 3-5 | 5-2 | 3-5 | 5-2 | 3-5 |
| 2-7 | 4-4 | 6-1 | 2-7 | 4-4 | 6-1 |
| 5-3 | 3-6 | 5-3 | 3-6 | 5-3 | 3-6 |
| 6-2 | 4-5 | 6-2 | 4-5 | 6-2 | 4-5 |
| 7-1 | 3-7 | 5-4 | 7-1 | 3-7 | 5-4 |
| 6-3 | 4-6 | 6-3 | 4-6 | 6-3 | 4-6 |
| 5-5 | 7-2 | 5-5 | 7-2 | 5-5 | 7-2 |
| 8-1 | 4-7 | 6-4 | 8-1 | 4-7 | 6-4 |
| 5-6 | 7-3 | 5-6 | 7-3 | 5-6 | 7-3 |
| 6-5 | 8-2 | 6-5 | 8-2 | 6-5 | 8-2 |
| 7-4 | 9-1 | 5-7 | 7-4 | 9-1 | 5-7 |
| 6-6 | 8-3 | 6-6 | 8-3 | 6-6 | 8-3 |
| 9-2 | 7-5 | 9-2 | 7-5 | 9-2 | 7-5 |
| 8-4 | 10-1 | 6-7 | 8-4 | 10-1 | 6-7 |
| 9-3 | 7-6 | 9-3 | 7-6 | 9-3 | 7-6 |
| 10-2 | 8-5 | 10-2 | 8-5 | 10-2 | 8-5 |
| 7-7 | 9-4 | 11-1 | 7-7 | 9-4 | 11-1 |
| 10-3 | 8-6 | 10-3 | 8-6 | 10-3 | 8-6 |
| 9-5 | 11-2 | 9-5 | 11-2 | 9-5 | 11-2 |
| 8-7 | 10-4 | 12-1 | 8-7 | 10-4 | 12-1 |
| 9-6 | 11-3 | 9-6 | 11-3 | 9-6 | 11-3 |
| 10-5 | 12-2 | 10-5 | 12-2 | 10-5 | 12-2 |
| | 9-7 | 11-4 | | 9-7 | 11-4 |
| 10-6 | 12-3 | 10-6 | 12-3 | 10-6 | 12-3 |
| | 11-5 | | 11-5 | | 11-5 |
| | 10-7 | 12-4 | | 10-7 | 12-4 |
| | 11-6 | | 11-6 | | 11-6 |
| | 12-5 | | 12-5 | | 12-5 |
| | | 11-7 | | | 11-7 |
| | 12-6 | | 12-6 | | 12-6 |
| | | | | | |
| | | 12-7 | | | 12-7 |

Fig. 18

Feeding Amount

↓2 ↓5 ↓2 ↓5 ↓2

Number of Times of Pass

| Raster Lines in Effective Range | 1 | 2 | 3 | 4 | 5 | 6 |
|---|---|---|---|---|---|---|
| | 1−1 | | | | | |
| | | | | | | |
| | | 2−1 | | | | |
| | | | | | | |
| | 1−2 | | | | | |
| | | | | | | |
| 1 | | 2−2 | | | | |
| 2 | | | 3−1 | | | |
| 3 | 1−3 | | | | | |
| 4 | | | | 4−1 | | |
| 5 | | 2−3 | | | | |
| 6 | | | 3−2 | | | |
| 7 | 1−4 | | | | | |
| 8 | | | | 4−2 | | |
| 9 | | 2−4 | | | 5−1 | |
| 10 | | | 3−3 | | | |
| 11 | | | | | | 6−1 |
| 12 | | | | 4−3 | | |
| 13 | | | | | 5−2 | |
| 14 | | | 3−4 | | | |
| 15 | | | | | | 6−2 |
| 16 | | | | 4−4 | | |
| 17 | | | | | 5−3 | |
| 18 | | | | | | |
| 19 | | | | | | 6−3 |
| 20 | | | | | | |
| 21 | | | | | 5−4 | |

PRINTER AND PRINTING THEREFOR

BACKGROUND OF THE INVENTION

1. Field of the Invention

The present invention relates to a printing apparatus and a method of printing. More specifically, the present invention pertains to a printing apparatus that drives a print head to form a raster line, which includes an array of dots arranged in one direction of a printing medium, and carries out a sub-scan, which feeds the printing medium relative to the print head in another direction that crosses the raster line whenever the raster line is formed, thereby printing an image, as well as to a method of such printing.

In this specification, the raster line that includes an array of dots arranged in one direction of the printing medium implies an array of dots created by at least one of the dot-forming elements without a feed in the sub-scanning direction. The direction of the dot array is hereinafter referred to as the main scanning direction, and the direction crossing the dot array as the sub-scanning direction.

2. Discussion of the Background

The printing apparatus, especially an ink jet printer, causes dot-forming elements, such as nozzles, mounted on a print head to spray ink against a printing medium and create dots of the ink on the surface of the printing medium, so as to implement printing. One typical arrangement of the ink jet printer has a print head that scans the surface of the printing medium (sheet of printing paper) to form raster lines.

A known ink jet printer of this arrangement has a nozzle array on the print head, which includes a plurality of nozzles arranged at a predetermined pitch in the sub-scanning direction. The print head of this structure simultaneously prints a plurality of lines by the plurality of nozzles in one main scan (pass).

In the case of the ink jet printer with such a print head, some scatter in properties of the respective nozzles or scatter in pitch between the plurality of nozzles causes the occurrence of banding and thereby deteriorates the picture quality of an image printed on the printing medium.

One known printing technique to prevent such deterioration of the picture quality is constant pitch sub-scan printing. This printing technique is also called interlace printing. The constant pitch sub-scan printing uses a nozzle array on a print head, which includes a plurality of nozzles arranged in the sub-scanning direction at intervals of an integral multiple of a dot pitch that corresponds to the dot of the printing resolution.

The printing medium is fed in the sub-scanning direction by a constant distance corresponding to n dot pitch after each pass, where N nozzles (where N is a positive integer) are arranged in the sub-scanning direction in the nozzle array, n nozzles (where n is a positive integer of not greater than N) are actually driven among the N nozzles arranged in the nozzle array, and the pitch between the nozzles is equal to k dot pitch, which is the minimum pitch of dots created on the printing medium (where k is a positive integer not greater than n and is prime to n).

In the constant pitch sub-scan printing technique, adjoining raster lines in the sub-scanning direction are printed by different nozzles. Even when there is some scatter in properties and pitch of the respective nozzles, this arrangement effectively reduces the deterioration of the picture quality of the printing image due to the scatter and thereby ensures printing of the high picture quality.

In addition to printing of letters and characters, the recent trend requires printing of multi-tone images, such as photographic images, at high quality. A variety of improvements have been given to the ink jet printer to enable printing of fine dots and meet the requirement. A known technique to print a multi-tone image doubles the driving frequency of the ink jet nozzles in the main scanning direction and thereby enhances the dot density in the main scanning direction. A proposed technique to enhance the dot density in the sub-scanning direction decreases the feeding amount of the printing medium in the sub-scanning direction to ensure finer sheet feeding.

Even when the constant pitch sub-scan printing technique is applied to attain high-quality printing, accumulation of errors of sheet feeding (feeding errors) may result in banding. By way of example, in constant pitch sub-scan printing, it is assumed that the upper dot out of two consecutive dots in the sub-scanning direction is printed by a last nozzle included in a selected group of nozzles in a specific pass, whereas the lower dot is printed by a first nozzle included in the selected group of nozzles. In this case, the passes for creating these dots are discontinuous in time. This causes a large accumulated error of sheet feeding between the two dots and facilitates the occurrence of banding.

In the recent ink jet printers, the constant pitch sub-scan printing is implemented by adopting an overlap printing technique that causes dots printed in a subsequent pass to partly overlap the dots printed in a preceding pass, with a view to realizing high-quality printing. If there is a significant time interval between printing of a dot in the preceding pass and the printing of a dot in the subsequent pass, the ink of the dot in the preceding pass is dried up before the dot is printed in the subsequent pass. This results in a poor combination of these two dots and causes a significant difference in printing density, compared with other overlapped portions. This undesirably causes the occurrence of banding.

The above description of the problem of the deteriorating picture quality is in reference to an ink jet printer that creates dots, while the print head moves in the main scanning direction. This problem is, however, not restricted to an ink jet printer, but may be found in any printers that create an image as a set of dots, such as a thermal wax-transfer printer. The problem also arises in the printing apparatuses that carry out the feed in the sub-scanning direction, whereas the print head is not required to move in the main scanning direction.

SUMMARY OF THE INVENTION

The object of the present invention is thus to provide a printing apparatus with a plurality of dot-forming elements arranged in the sub-scanning direction, which solves the problem of the prior art printing apparatuses that create an image as a set of dots and carries out the high-quality printing without deterioration of the picture quality due to banding.

At least part of the above and the other related objects is realized by a printing apparatus that drives a print head to form a raster line, which includes an array of dots arranged in one direction in a printing medium, and carries out a sub-scan, which feeds the printing medium relative to the print head in another direction that crosses the raster line whenever the raster line is formed, thereby printing an image. The printing apparatus includes:

a dot-forming element array that is mounted on the print head and includes N dot-forming elements for creating dots on the printing medium, the N dot-forming elements being arranged at a k dot pitch, which corresponds to a minimum pitch between dots created on the printing medium, in the sub-scanning direction;

a print head driving unit that drives the print head and causes required dot-forming elements in the dot-forming element array to create dots on the printing medium;

a sub-scan control unit that carries out the feed of the printing medium in the sub-scanning direction after each pass of raster creation, which drives the print head driving unit to form at least part of the raster line; and a dot creation control unit that selects n dot-forming elements (where n is a positive integer of less than N) among the dot-forming element array and causes a raster line to be formed on the printing medium in each pass, the dot creation control unit causing a remaining dot-forming element other than the n dot-forming elements selected among the dot-forming element array create a dot adjoining to two dots, which are created by two passes having a significant time interval between them.

The present invention is also directed to a method corresponding to this printing apparatus. This method drives a print head to form a raster line, which includes an array of dots arranged in one direction of a printing medium, and carries out a sub-scan, which feeds the printing medium relative to the print head in another direction that crosses the raster line whenever the raster line is formed, thereby printing an image. The method includes the steps of:

driving the print head and causing a dot-forming element array mounted on the print head to create dots on the printing medium, wherein the dot-forming element array includes N dot-forming elements for creating dots on the printing medium and the N dot-forming elements are arranged at a k dot pitch, which corresponds to a minimum pitch between dots created on the printing medium, in the sub-scanning direction;

carrying out the feed of the printing medium in the sub-scanning direction after each pass of raster creation to form at least part of the raster line; and selecting n dot-forming elements (where n is a positive integer of less than N) among the dot-forming element array and causing a raster line to be formed on the printing medium in each pass, while causing a remaining dot-forming element other than the n dot-forming elements selected among the dot-forming element array to create a dot adjoining two dots, which are created by two passes having a significant time interval between them.

In the printing apparatus and the corresponding method of the present invention, the dots are created on the printing medium by the dot-forming element array, which includes a plurality of dot-forming elements arranged at a predetermined pitch in the sub-scanning direction. The structure of the present invention carries out the feed of the printing medium in the sub-scanning direction after each pass, which drives the print head driving unit and forms at least part of a raster line. The procedure carries out the control to select n dot-forming elements among the dot-forming element array and form a raster line on the printing medium by a certain pass. The procedure also causes a dot adjoining the two dots created by the two passes having a significant time interval between them to be created by a dot-forming element other than the selected dot-forming elements among the dot-forming element array. This arrangement of the invention utilizes the dot-forming element that is not selected in the conventional dot creating process, and thereby enhances the utilization ratio of the dot-forming elements. No new pass is required to create a dot adjoining the two dots created by the two passes having a significant time interval between them. This structure does not undesirably extend the time required for printing.

The two passes having a significant time interval between them may be two passes that are discontinuous in time. The discontinuous passes in time facilitate accumulation of the feeding errors in the sub-scanning direction. It is accordingly effective to cause the unselected dot-forming element to create a dot that adjoins to the two dots created by the two discontinuous passes in time.

There are a variety of printing techniques that create close dots by the two passes having a significant time interval between them. By way of example, when s dot-forming elements included in the n dot-forming elements aligned in the sub-scanning direction in the dot-forming element array are used to form one raster line, a value n/s and the pitch k of the dot-forming elements are prime to each other, and the printing medium is fed by n/s dot pitch in the sub-scanning direction after each pass. This arrangement enables the selected n dot-forming elements to efficiently create dots by the interlace technique.

In the printing apparatus of such a structure, one possible application drives the sub-scan control unit and the print head driving unit and causes part of the selected dot-forming elements to print dots in a subsequent pass, which partly overlap dots created in a preceding pass by the selected dot-forming elements. This arrangement causes one raster line to be formed by a plurality of dot-forming elements. This effectively cancels the problem due to a scatter of the dot-forming elements.

The two dots formed by the two passes having the significant time interval between them may adjoin each other in the sub-scanning direction or may adjoin each other in both the sub-scanning direction and the main scanning direction.

The n dot-forming elements selected among the N dot-forming elements may not include end dot-forming elements of the dot-forming element array. In this case, the dot adjoining the two dots created by the two passes having the significant time interval between them is formed by each dot-forming element of the dot-forming element array. Banding often occurs in the end of the dot-forming element array. Formation of the dot adjoining the two dots created by the two passes by the end dot-forming element thus effectively prevents the occurrence of banding.

When the interval between the plurality of dot-forming elements is not less than 2 dot pitch, the use of all the N dot-forming elements may cause an interlace condition to fail. Such failure of the interlace condition occurs, for example, in the case where the number of effective dot-forming elements N/s, which is determined by taking into account the number of dot-forming elements s used to create a raster line, is not an integer or in the case where the number of effective dot-forming elements N/s is not prime to the dot pitch k between the dot-forming elements, while the number of effective dot-forming element N/s is equal to a feeding amount L in the sub-scanning direction. In these case, n dot-forming elements (where n is an integer of less than N) are selected among the N dot-forming elements. Such selection enables the n dot-forming elements to satisfy the interlace conditions. Each of unselected (N-n) dot-forming elements is used to create a dot adjoining the two dots created by the two passes having a significant time interval. This arrangement implements the interlace printing with no special pass, thereby ensuring the advantages of dot creation without extending the printing time.

In accordance with another preferable application, a different number of dot-forming elements are selected among the dot-forming element array for part of a plurality of passes from a number of dot-forming elements selected for the other passes. The feed of the printing medium in the sub-scanning direction is then carried out according to the number of selected dot-forming elements. The number of dot-forming elements used for each pass may not be fixed at a constant value. The feed in the sub-scanning direction depends upon the number of selected dot-forming elements. It is not necessary to fix the number of dot-forming elements, each of which is used to create a dot adjoining the two dots created by discontinuous passes. All or part of the unselected dot-forming elements may be applied for such dot-forming elements.

A typical example of the dot-forming element in the printing apparatus is a nozzle that spouts ink and creates dots on the printing medium. The principle of the present invention is, however, also applicable to other printing apparatuses in which ink is not spouted, for example, an impact dot matrix printer and a thermal wax-transfer printer. The respective units or steps of the present invention may be actualized electrically by memories and controllers. The controller may be a general-purpose control element, such as a CPU, or an exclusive control circuit.

The printing apparatus of the present invention having any one of the above structures may be the type that forms raster lines through main scans that reciprocate the head relative to the printing medium as well as the type that forms raster lines without such main scans.

In any of the printing apparatuses of the present invention discussed above, the computer may control the head for recording dots and the sub-scan according to a preset program. Another application of the present invention is a recording medium, in which such a program is recorded.

The present invention is thus directed to a recording medium, in which a program is recorded in a computer readable manner, wherein the program causes the computer to drive a print head to form a raster line, which includes an array of dots arranged in one direction of a printing medium, and carry out a sub-scan, which feeds the printing medium relative to the print head in another direction that crosses the raster line whenever the raster line is formed, thereby printing an image. The program realizes the functions of:

driving the print head and causing a dot-forming element array mounted on the print head to create dots on the printing medium, wherein the dot-forming element array includes N dot-forming elements for creating dots on the printing medium and the N dot-forming elements are arranged at a k dot pitch, which corresponds to a minimum pitch between dots created on the printing medium, in the sub-scanning direction;

carrying out the feed of the printing medium in the sub-scanning direction after each pass of raster creation to form at least part of the raster line; and selecting n dot-forming elements (where n is a positive integer of less than N) among the dot-forming element array and causing a raster line to be formed on the printing medium in each pass, while causing a remaining dot-forming element other than the n dot-forming elements selected among the dot-forming element array to create a dot adjoining -to- two dots, which are created by two passes having a significant time interval.

The computer executes the program recorded in the recording medium to actualize the printing apparatus of the present invention discussed above. Available examples of the recording media include flexible disks, CD-ROMs, magneto-optic discs, IC cards, ROM cartridges, punched cards, prints with barcodes or other codes printed thereon, internal storage devices (memories like a RAM and a ROM) and external storage devices of the computer, and a variety of other computer readable media. Another application of the present invention is a program supply apparatus that supplies a computer program, which causes the computer to realize the control functions of the printing apparatus, via a communications path.

BRIEF DESCRIPTION OF THE DRAWINGS

FIG. 13 shows the state of dot creation with the number of buses and the driving nozzle numbers;

FIG. 15 shows the state of dot creation with the number of buses and the driving nozzle numbers;

FIG. 16 shows the state of dot creation with a nozzle array including seven nozzles;

FIG. 17 shows the state of dot creation with the number of buses and the driving nozzle numbers; and FIG. 18 shows the state of dot creation when the feed in the sub-scanning direction is varied.

DETAILED DESCRIPTION OF THE PREFERRED EMBODIMENTS

One mode for carrying out the present invention is described below as a preferred embodiment.

(1) Structure of Apparatus

Figure 1:
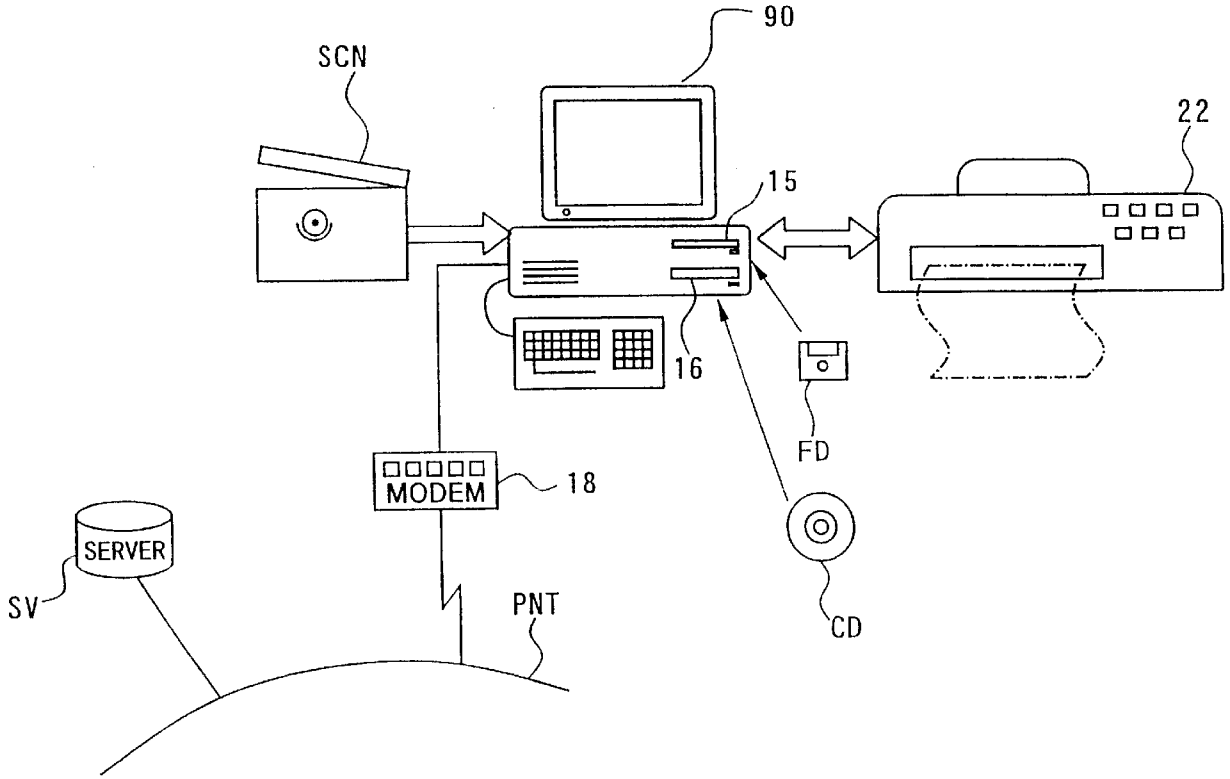
FIG. 1 schematically illustrates the structure of a printing apparatus embodying the present invention.

FIG. 1 is a block diagram illustrating the structure of an image processing apparatus including a color printer 22, which embodies the printing apparatus of the present invention. A scanner SCN and the color printer 22 are connected to a computer 90 as illustrated. The computer 90 processes the images taken in with, for example, the scanner SCN, according to a variety of applications programs. In response to an instruction for printing an image output from an applications program, the computer 90 activates a printer driver installed therein, converts print image data into print data printable by the printer 22, and outputs the print data to the printer 22. The printer 22 receives the print data and executes a variety of control operations discussed below to print an image. As described later, the printer 22 of the embodiment carries out printing in various modes. The data transferred from the computer 90 to the printer 22 include data for specifying a print mode.

The computer 90 includes a flexible disk drive 15 and a CD-ROM drive 16, which are used to read programs recorded in a flexible disk FD and a CD-ROM, respectively. The computer 90 is connectable with a public telephone network PNT via a modem 18. The computer 90 can access a specific server SV connected to an external network via the public telephone network PNT and download programs from the server SV into an internal hard disk of the computer 90. The computer 90 can transfer a variety of data to the printer 22, so that the programs may be transferred to the printer 22.

Figure 2:
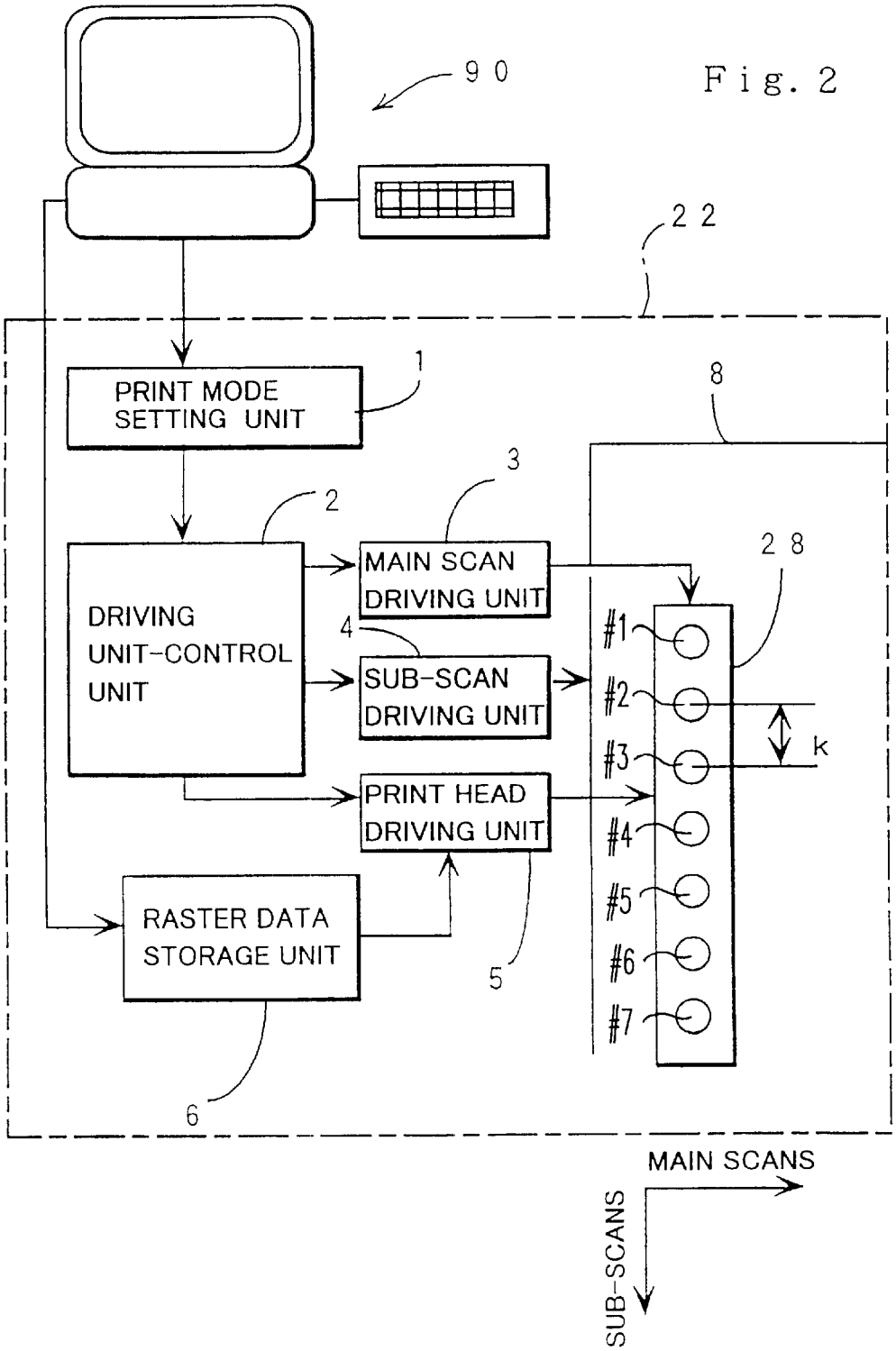
FIG. 2 schematically illustrates the functions of a printer 22 in the embodiment.

FIG. 2 is a block diagram showing the conceptual structure of the embodiment. The printer 22 of the embodiment includes a print mode setting unit 1, a driving unit-control unit 2, a main scan driving unit 3, a sub-scan driving unit 4, a print head driving unit 5, a raster data storage unit 6, and a print head 28. The printer 22 creates dots on a printing medium (standard paper in this embodiment) 8 to implement printing.

The print mode setting unit 1 receives a specification from the computer 90 and instructs the driving unit-control unit 2 to set a specific print mode. For example, the print mode setting unit 1 selects one among available print modes including a constant pitch sub-scan print mode and an overlap print mode. The print mode here specifies a series of settings, that is, how the image data input from the computer 90 are developed to raster data, which technique is applied to move the print head 28 in a main scanning direction and a sub-scanning direction, and which sequence is applied to transfer the raster data to the print head 28. The driving unit-control unit 2 controls the driving amounts and the driving timings of the print head 28 and the printing medium 8 by the main scan driving unit 3 and the sub-scan driving unit 4.

The main scan driving unit 3 drives the print head 28 in the main scanning direction of FIG. 2. The sub-scan driving unit 4 feeds the printing medium 8 by a predetermined amount in the sub-scanning direction.

The print head driving unit 5 drives required nozzles out of a plurality of nozzles, which constitute a nozzle array on the print head 28, based on the print image data stored in the raster data storage unit 6. A concrete procedure supplies electricity to driving elements of the required nozzles. This driving operation enables the nozzle array to spout ink onto the printing medium 8 and create dots of a predetermined size on the printing medium 8.

Figure 3:
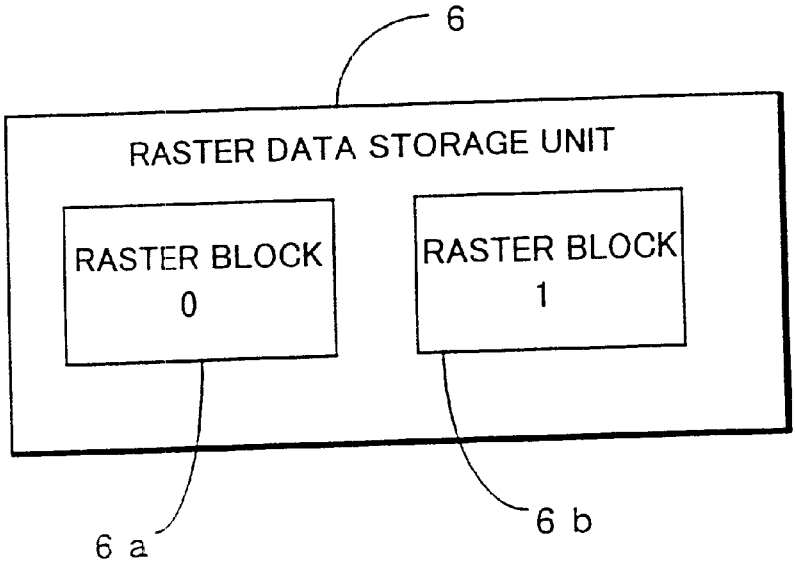
FIG. 3 shows the structure of a raster data storage unit.

The raster data storage unit 6 includes a memory, in which print image data including multi-valued tone information transferred from the computer 90 are stored. The raster data storage unit 6 has a plurality of data block areas, that is, a first raster block (raster block 0) 6*a* and a second raster block (raster block 1) 6*b* as illustrated in FIG. 3. The first raster block 6*a* and the second raster block 6*b* respectively provide, for example, a 2-bit memory area with respect to each dot in a printed image. Combinations of these 2-bit memory areas allow four-valued tone information (00,01, 10,11) with respect to each dot. In the actual printer 22, however, such tone information enables three-valued printing with respect to each dot.

The print head 28 has a nozzle array, in which a predetermined number of nozzles are arranged at a fixed nozzle pitch. In the illustrated example, seven nozzles #1 through #7 are arrayed at nozzle intervals of k dot pitch in the sub-scanning direction.

Figure 4:
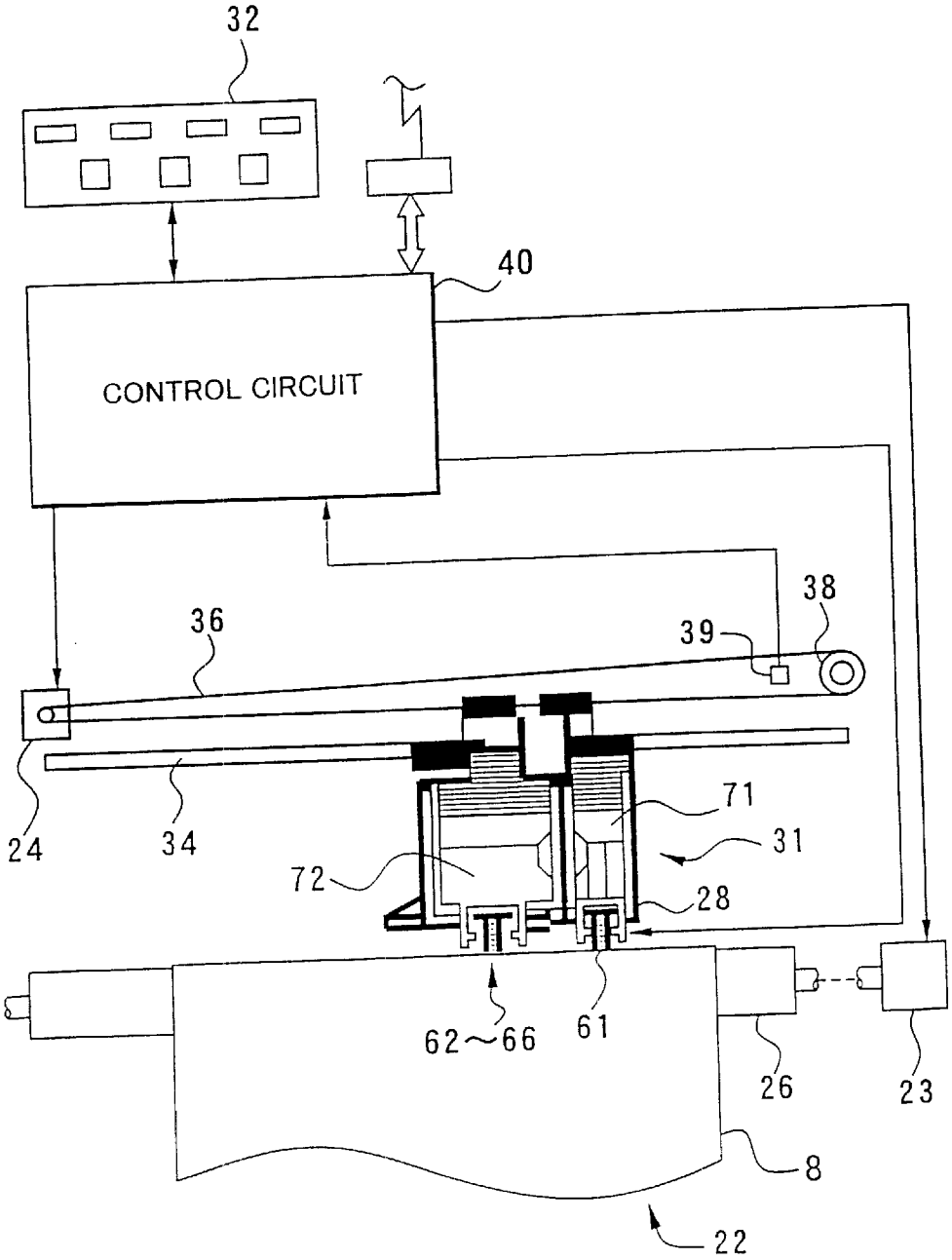
FIG. 4 schematically illustrates the structure of the printer in the embodiment.

The schematic structure of the printer 22 is described in the drawing of FIG. 4. As illustrated in FIG. 4, the printer 22 has a mechanism for causing a sheet feed motor 23 to feed the printing medium 8, a mechanism for causing a carriage motor 24 to reciprocate a carriage 31 in an axial direction of a platen 26, a mechanism for driving the print head 28 mounted on the carriage 31 to control spout of ink and creation of dots, and a control circuit 40 that controls transmission of signals to and from the sheet feed motor 23, the carriage motor 24, the print head 28, and a control panel 32. The following describes these mechanisms in this sequence.

The mechanism for reciprocating the carriage 31 in the axial direction of the platen 26 includes a sliding shaft 34 that is arranged in parallel to the axis of the platen 26 and slidably supports the carriage 31, an endless drive belt 36 that is spanned between the carriage motor 24 and a pulley 38, and a position sensor 39 that detects the position of the origin of the carriage 31.

A black ink cartridge 71 for black ink (Bk) and a color ink cartridge 72 in which five color inks, that is, cyan (C1), light cyan (C2), magenta (M1), light magenta (M2), and yellow (Y), are accommodated may be mounted on the carriage 31. Both the higher-density ink (dark ink) and the lower-density ink (light ink) are provided for the two colors, cyan and magenta. A total of six ink spout heads 61 through 66 are formed on the print head 28 that is disposed in the lower portion of the carriage 31, and ink supply conduits 67 (see FIG. 5) are formed in the bottom portion of the carriage 31 for leading supplies of inks from ink tanks to the respective ink spout heads 61 through 66. When the black ink cartridge 71 and the color ink cartridge 72 are attached downward to the carriage 31, the ink supply conduits 67 are inserted into connection apertures (not shown) formed in the respective cartridges. This enables supplies of inks to be fed from the respective ink cartridges to the ink spout heads 61 through 66.

Figure 5:
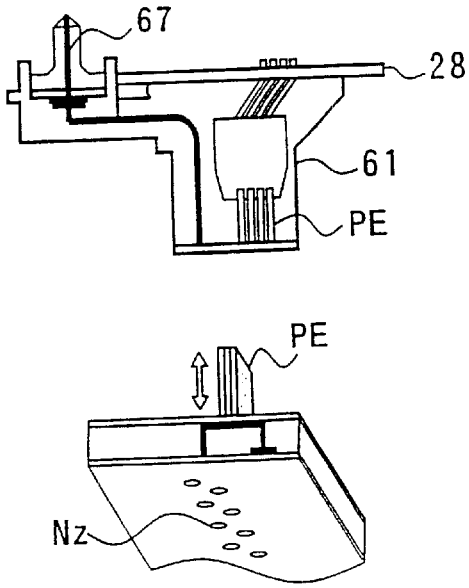
FIG. 5 schematically illustrates the structure of a dot record head of the printer in the embodiment.

The following describes the mechanism of spouting ink and creating dots. FIG. 5 schematically illustrates the internal structure of the print head 28. When the ink cartridges 71 and 72 are attached to the carriage 31, supplies of inks in the ink cartridges 71 and 72 are sucked out by capillarity through the ink supply conduits 67 and are led to the ink spout heads 61 through 66 formed in the print head 28 arranged in the lower portion of the carriage 31 as shown in FIG. 5. In the case where the ink cartridges 71 and 72 are attached to the carriage 31 for the first time, a pump works to suck first supplies of inks into the respective ink spout heads 61 through 66. In this embodiment, structures of the pump for suction and a cap for covering the print head 28 during the suction are not illustrated nor described specifically.

Figure 6:
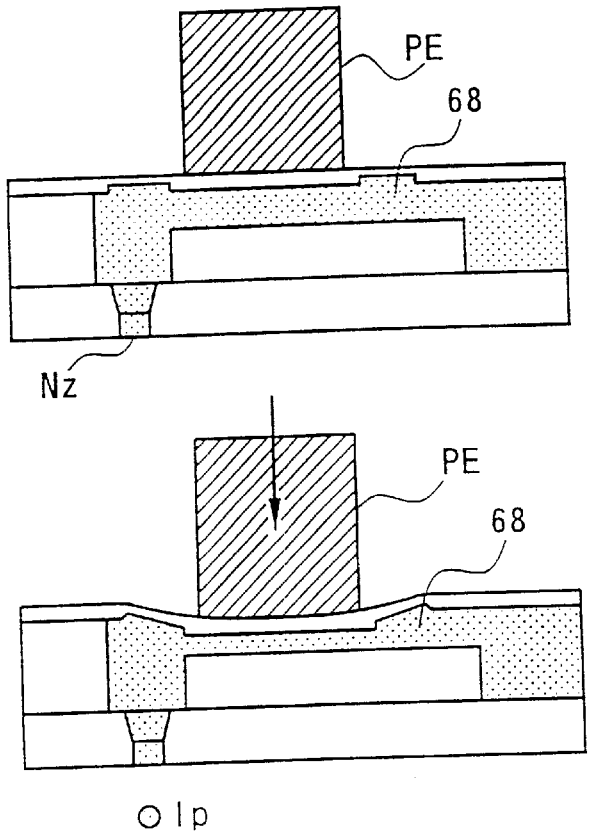
FIG. 6 shows the principle of dot creation in the printer of the embodiment.

An array of forty-eight nozzles Nz (see FIG. 7) is formed in each of the ink spout heads 61 through 66 as discussed later. A piezoelectric element PE, which is one of electrically distorting elements and has an excellent response, is arranged for each nozzle Nz. FIG. 6 illustrates a configuration of the piezoelectric element PE and the nozzle Nz. As shown in the upper drawing of FIG. 6, the piezoelectric element PE is disposed at a position that comes into contact with an ink conduit 68 for leading ink to the nozzle Nz. As is known, the piezoelectric element PE has a crystal structure that is subjected to mechanical stress due to application of a voltage and thereby carries out extremely high-speed conversion of electrical energy to mechanical energy. In this embodiment, application of a voltage between electrodes on either ends of the piezoelectric element PE for a predetermined time period causes the piezoelectric element PE to extend for a predetermined time period and deform one side wall of the ink conduit 68 as shown in the lower drawing of FIG. 5. The volume of the ink conduit 68 is reduced with an extension of the piezoelectric element PE, and a certain amount of ink corresponding to the reduced volume is sprayed as an ink particle Ip from the end of the nozzle Nz at a high speed. The ink particles Ip soak into the printing medium 8 set on the platen 26, so as to implement printing.

Figure 7:
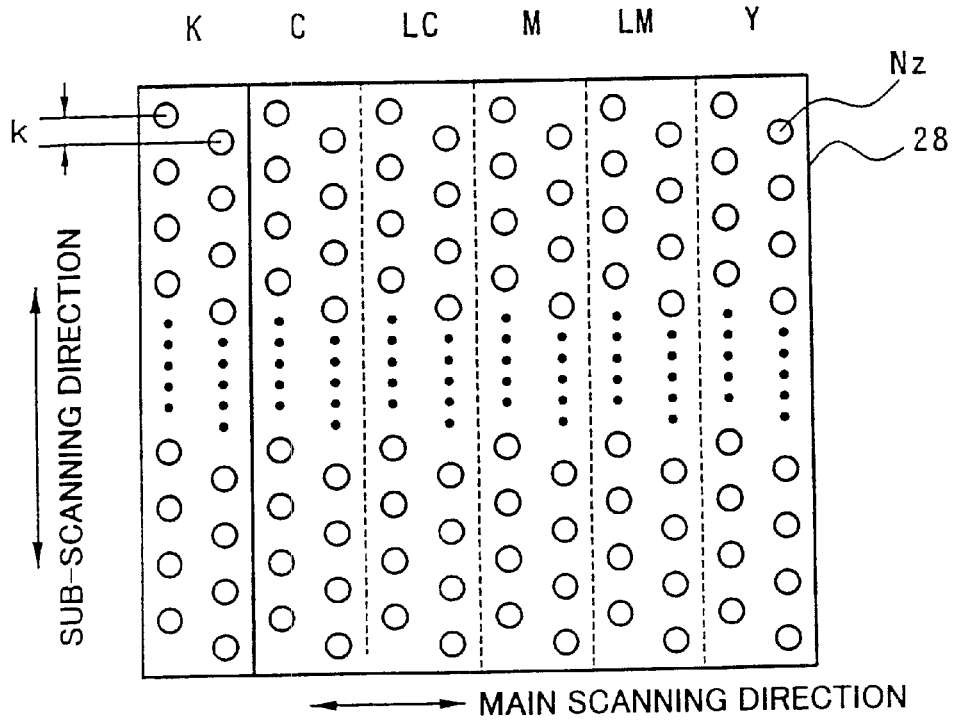
FIG. 7 shows an exemplified arrangement of nozzle arrays in the printer of the embodiment.

FIG. 7 shows an arrangement of the ink jet nozzles Nz in the ink spout heads 61 through 66. The arrangement includes six nozzle arrays, wherein each nozzle array spouts ink of each color and includes forty-eight nozzles Nz arranged in zigzag at a fixed nozzle pitch k. The positions of the nozzles in the sub-scanning direction are identical in the respective nozzle arrays. The forty-eight nozzles Nz included in each nozzle array may be arranged in alignment instead of in zigzag. The zigzag arrangement shown in FIG. 7, however, allows a small value to be set to the nozzle pitch k in the manufacturing process.

Figure 8:
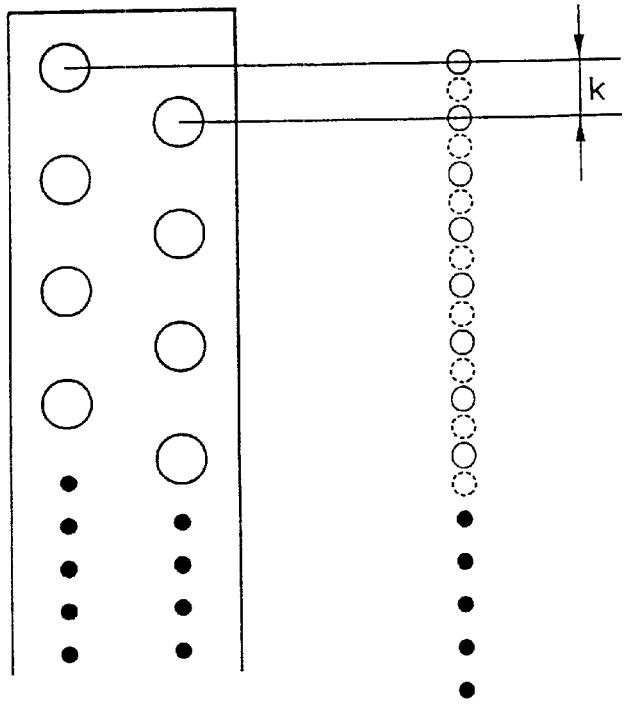
FIG. 8 shows an enlarged nozzle array in the printer of the embodiment and the dots created by the nozzle array.

FIG. 8 shows an enlarged nozzle array and the dots created by the nozzle array. The leftward drawing of FIG. 8 shows an enlarged nozzle array, and the rightward drawing shows the state of dots created by the nozzle array. The circles shown by the broken line in the rightward drawing denote the dots that can be created after a sub-scan of the nozzle array. In the example of FIG. 8, the nozzle pitch to the record pitch is accordingly set equal to 2 to 1. In order to prevent dropout of a dot, each dot has the diameter that partly overlaps the adjoining dots both in the main scanning direction and in the sub-scanning direction.

Figure 9:
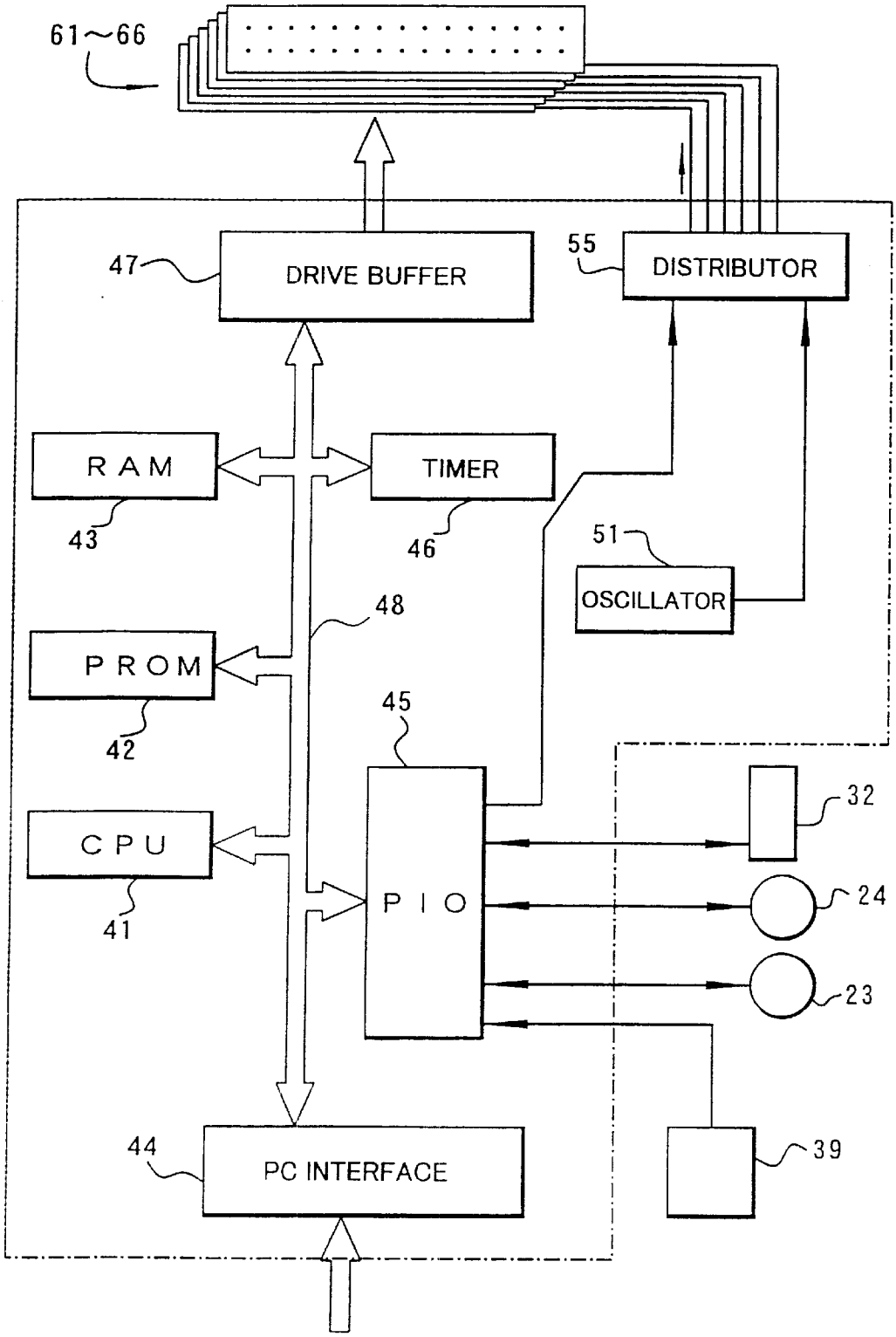
FIG. 9 shows the internal structure of a control apparatus of the printer.

The following describes the internal structure of the control circuit 40 of the printer 22 and the method of driving the head 28 with the plurality of nozzles Nz shown in FIG. 7. FIG. 9 illustrates the internal structure of the control circuit 40. Referring to FIG. 9, the control circuit 40 includes a CPU 41, a PROM 42, a RAM 43, a PC interface 44 that transmits data to and from the computer 90, a peripheral input-output unit (PIO) 45 that transmits signals to and from the sheet feed motor 23, the carriage motor 24, and the control panel 32, a timer 46 that counts the time, and a drive buffer 47 that outputs dot on/off signals to the heads 61 through 66. These elements and circuits are mutually connected via a bus 48.

The control circuit 40 further includes an oscillator 51 that outputs driving waveforms (see FIG. 10) at a predetermined frequency and a distributor 55 that distributes the output of the oscillator 51 into the heads 61 through 66 at a specified timing. The control circuit 40 receives the print image data processed by the computer 90, temporarily registers the processed print image data into the RAM 43, and outputs the print image data to the drive buffer 47 at a specific timing. The control circuit 40 controls the main scans of the carriage 31, the driving operations of the respective nozzles, and the sub-scans. The drive buffer 47 corresponds to the raster data storage unit 6 shown in FIG. 2.

Figure 10:
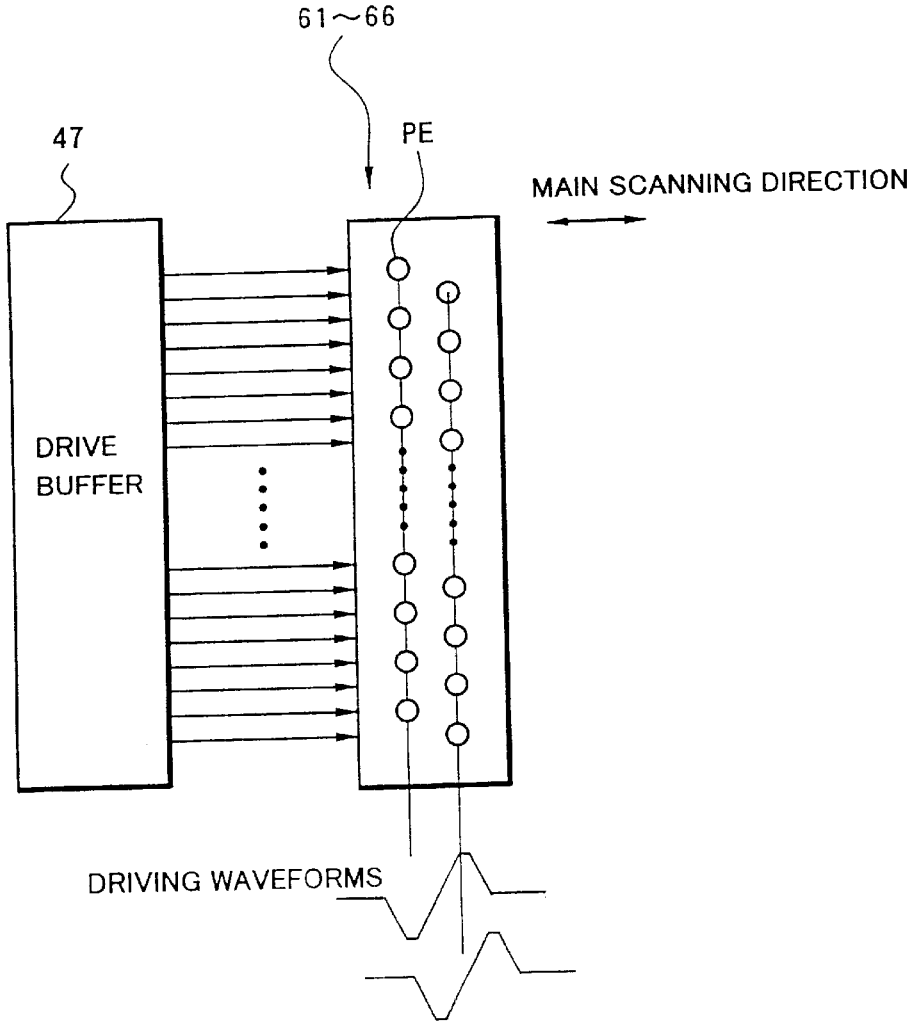
FIG. 10 shows the state of transferring signals for creating dots to the head.

The control circuit 40 outputs the signals to the heads 61 through 66 in the following manner. FIG. 10 shows a connection in one nozzle array on the heads 61 through 66. One nozzle array on the heads 61 through 66 is incorporated in a circuit that has the drive buffer 47 as the source and the distributor 55 as the drain. Each piezoelectric element PE included in the nozzle array has one electrode connected to each output terminal of the drive buffer 47 and the other electrode commonly connected to the output terminal of the distributor 55. The driving waveforms of the oscillator 51 are output from the distributor 55 as shown in FIG. 10. When the CPU 41 determines the ON-OFF state of each nozzle and outputs the corresponding signal to each terminal of the drive buffer 47, only the piezoelectric elements PE that have received the ON signal from the drive buffer 47 are driven in response to the driving waveforms. This arrangement enables all the corresponding nozzles of the piezoelectric elements PE that have received the ON signal from the drive buffer 47 to spout the ink particles Ip.

As shown in FIG. 7, the heads 61 through 66 are arranged in the feeding direction of the carriage 31, so that the respective nozzle arrays reach a fixed position on the printing medium 8 at different time. The CPU 41 accordingly takes account of the positional difference of the respective nozzles on the heads 61 through 66 and outputs the ON-OFF signals of the respective dots at required time via the drive buffer 47, so as to create dots of the respective colors. The output of the ON-OFF signals is controlled by taking into account the two-column nozzle arrangement on each of the heads 61 through 66 as shown in FIG. 7.

In the printer 22 having the hardware structure discussed above, while the sheet feed motor 23 rotates the rollers in the sheet feeding mechanism and the other related rollers to feed the printing medium 8, the carriage motor 24 reciprocates the carriage 31, simultaneously with actuation of the piezoelectric elements PE on the respective ink spout heads 61 through 66 of the print head 28. The printer 22 accordingly sprays the respective color inks to create dots and thereby forms a multi-color image on the printing medium.

In this embodiment, the printer 22 has the head that uses the piezoelectric elements PE to spout ink as discussed previously. The printer may, however, adopt another technique for spouting ink. One available structure of the printer supplies electricity to a heater installed in an ink conduit and utilizes the bubbles generated in the ink conduit to spout ink. Other examples include a impact dot matrix printer and a thermal wax-transfer printer.

(2) Print Control Process

Figure 11:
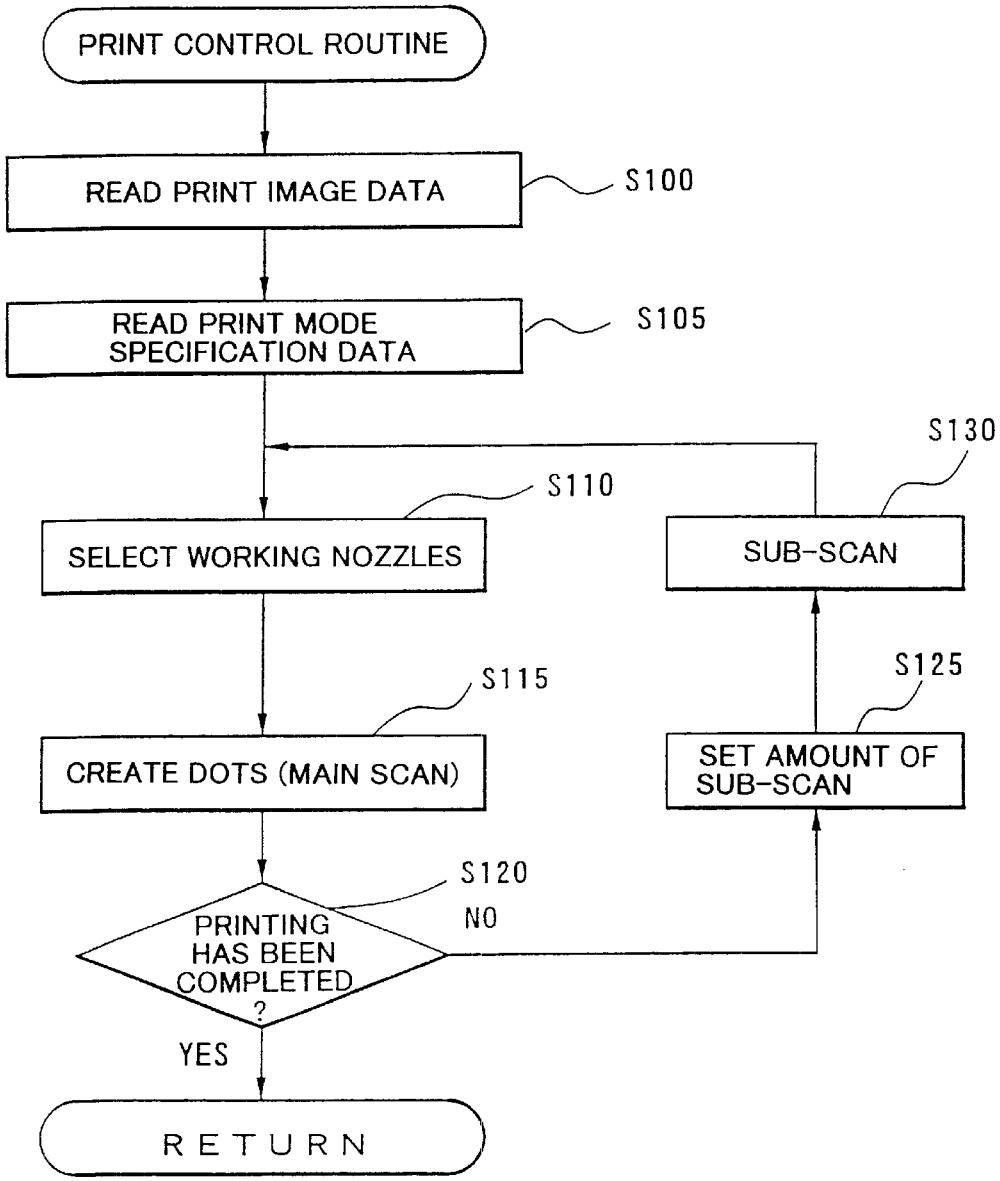
FIG. 11 is a flowchart showing a print control routine.

The following describes a print control process carried out in the printer 22 of the embodiment. FIG. 11 is a flowchart showing a print control routine. This processing is executed by the CPU 41 (see FIG. 9) of the printer 22. When the program enters the print control routine, the CPU 41 first reads print image data (step S100). The print image data have been processed by the computer 90 and include a series of data representing the ON-OFF state of the respective nozzles on each of the heads 61 through 66 in the printer 22. The CPU 41 reads print mode specification data together with the print image data (step S105) and selects working nozzles, which will be activated and used, based on the print mode specification data (step S110).

The specification of the print mode and the selection of the working nozzles will be described later in detail. A concrete procedure of the selection of the working nozzles selects the nozzles required for forming raster lines among the plurality of nozzles provided in the print head 28. The unselected nozzle here does not mean an unused nozzle, but may be used as a nozzle for creating a dot that adjoins to two dots that have been created by discontinuous main seans in time. In some cases, all the nozzles may be the selected nozzles. In other cases, different nozzles may be selected for every main scan. As described previously, the printer 22 of the embodiment actually has forty-eight nozzles on each head. For convenience of explanation, some examples of printing are described hereinafter with various numbers of nozzles.

After the selection of the working nozzles, the print head 28 is moved in the main scanning direction to create dots (step S115). After conclusion :of the main scan, it is determined whether or not printing has been completed (step S120). When printing has not been completed yet, the program sets the amount of sub-scan (step S125) and feeds the printing medium 8 by the preset amount of sub-scan (step S130). The program then returns to the selection of the working nozzles. Until printing is completed, the method repeats the selection of the working nozzles, the scan of the print head 28 in the main scanning direction to create dots, and the sub-scan. In the case where the selected working nozzles and the amount of sub-scan are fixed at constant values, the step of selecting the working nozzles (step S110) and the step of setting the amount of sub-scan (step S125) may be executed only once before printing.

(3) Creation of Dots

Figure 12:
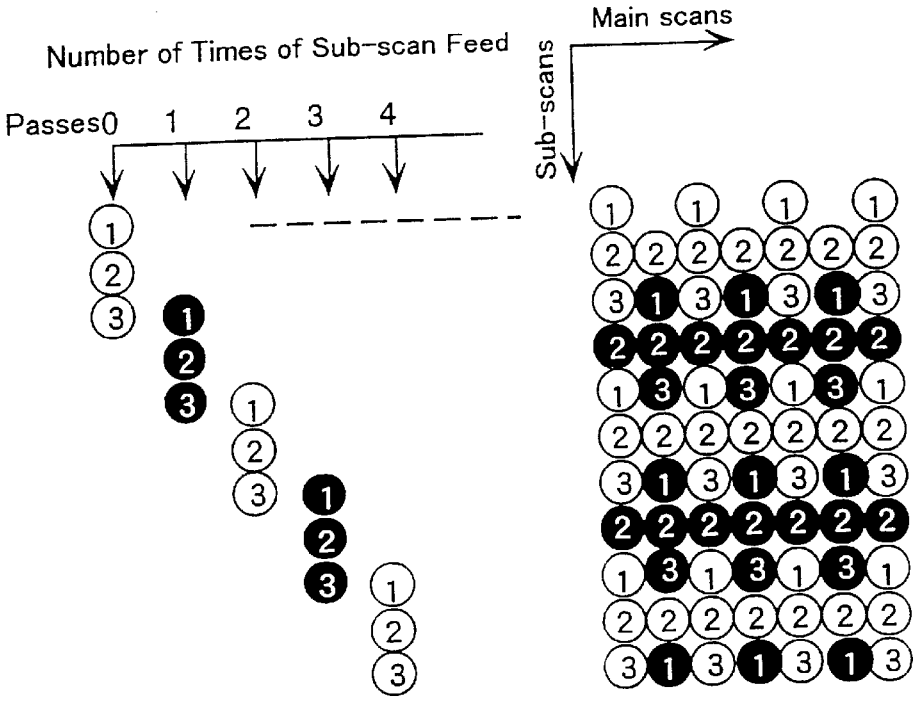
FIG. 12 shows the state of dot creation with a nozzle array including three nozzles.

Example with the number of nozzles N=3:

The following describes the state of dot creation by repeating the selection of the working nozzles, the main scan, and the sub-scan. FIG. 12 shows passes in the main scanning direction and the feeding amount in the sub-scanning direction after each pass, in the case where the present invention is applied to constant pitch sub-scan printing (the printing method with a fixed feeding amount of the head in the sub-scanning direction). As shown in FIG. 12(B), in this example, the total number of nozzles N is equal to 3, the number of selected nozzles n equal to 2, and the nozzle pitch k equal to 1. The example of FIG. 12 accordingly uses the print head with a nozzle array of three nozzles (#1 through #3) that are arranged at the intervals of 1 dot pitch (k=1) in the sub-scanning direction. In the case of this nozzle arrangement, the constant pitch sub-scan printing that feeds the printing medium by the pitch of 2 dots in the sub-scanning direction after each pass that carries out printing basically with two nozzles (#1 and #2) may be adopted to fill the printing medium 8 with dots. This is clearly understood from the state of the working nozzles shown in FIG. 12(C), where the third nozzle is not required to form raster lines in the main scanning direction. In FIG. 12 and subsequent figures, '1-1' means that the nozzle #1 is selected in the first pass and '2-2' means that the nozzle #2 is selected in the second pass.

The example of FIG. 12 uses the nozzle #3, which is not used in the process of constant pitch sub-scan printing, among the nozzle array and alternately drives the nozzle #3 in each pass. As a result, the nozzle #2 is driven every time in the main scanning direction, while the nozzles #1 and #3 are driven alternately as shown in FIG. 12(A). In the dual-way printing, the nozzle #2 may be driven in both the forward and backward ways, whereas the nozzle #1 is driven only in the forward way and the nozzle #3 is driven only in the backward way. FIG. 13 shows an example of dot creation attained by six passes. This table shows data of only 3 steps (6 dots) in the main scanning direction. In this example, dots are printed at the positions defined as '1-3', '2-3', '3-3', '4-3', '5-3', and '6-3' by driving the nozzle #3.

In the table of FIG. 13, banding tends to occur, due to accumulation of errors of sheet feeding, between a dot created by a last nozzle (nozzle #2) in a preceding pass and a dot created by a first nozzle (nozzle #1) in a subsequent pass. The arrangement of the embodiment prints a dot by the nozzle #3 between these two dots. In the example of FIG. 4, a dot '1-3' is positioned between the second top dot '1-2' and the fourth top dot '2-2' in a sub-scan line on the left side of step 1. This arrangement effectively prevents the banding.

Figure 14:
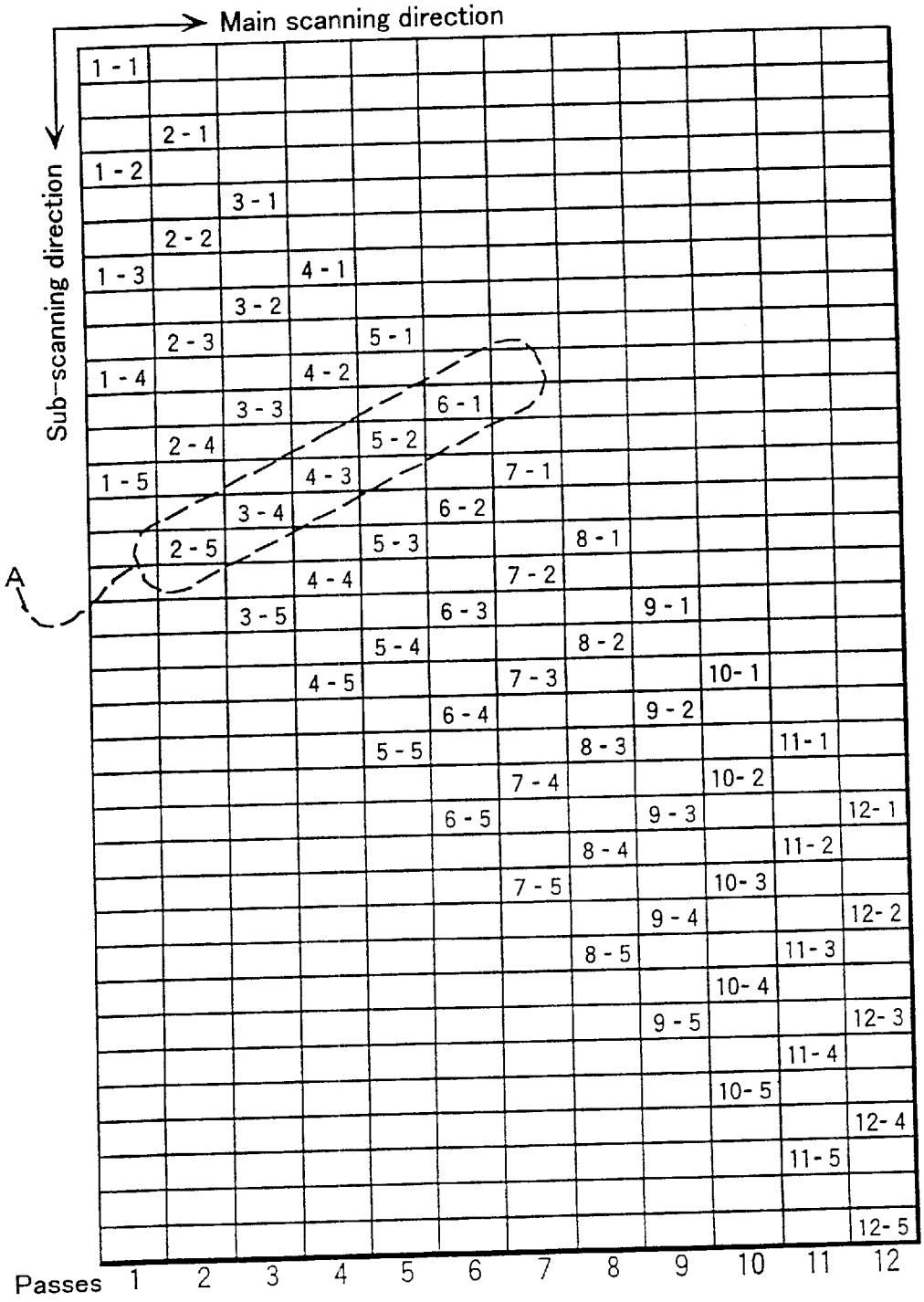
FIG. 14 shows the state of dot creation with a nozzle array including five nozzles.

Example with the number of nozzles N=5:

The following describes another example with the number of nozzles N=5 and the dot pitch k=3. The example shown in FIG. 14 uses the print head with a nozzle array of five nozzles (#1 through #5), which are arranged at the intervals of 3 dot pitch in the sub-scanning direction, as a specified print mode. In the case of this nozzle arrangement, the overlap printing technique is adopted to feed the printing medium by the pitch of 2 dots in the sub-scanning direction after each pass that carries out printing with four nozzles. In order to enable the printing medium 8 to be filled with dots, the procedure selects four nozzles (#1 through #4) out of the nozzle array and feeds the printing medium by the pitch of 2 dots in the sub-scanning direction after each pass that carries out printing in the main scanning direction with these selected nozzles. This causes each raster line to be formed by two nozzles and thereby attains the overlap printing. In the example of FIG. 14, 12 passes are carried out to form a pattern of 35 dots in the sub-scanning direction.

The arrangement of this embodiment uses the nozzle #5, which is not used in the process of overlap printing, among the nozzle array and drives the nozzles #5 in each pass. FIG. 15 shows an example of dot creation attained by 2 steps of these 12 passes. In this case, dots are printed at the positions defined as '1-5', '2-5', . . . ,'11-5', and '12-5' by driving the nozzle #5.

In an encircled portion with the symbol A in FIG. 14, lines are formed in the main scanning direction in the sequence of '3-4', '4-3', '5-2', and '6-1' by a series of consecutive passes. In the case of printing the adjoining dots by such consecutive passes, creation of an adjoining dot before ink of one dot is sufficiently dried causes the adjoining dots to be joined with each other. If the overlap printing is carried out only with the four nozzles #1 through #4 included in the nozzle array, an '8-1' dot is created by the nozzle #1 in the $8^{th}$ pass at the position adjoining to a '3-4' dot in the sub-scanning direction. In the description hereinafter, the position where a dot is created in the main scanning direction may be referred to as the 'column'. The adjoining configuration of the '3-4' dot and the '8-1' dot occurs at the rate of once every 2 columns in such raster lines. In the conventional overlap printing with only the four nozzles, this adjoining configuration of the '3-4' dot and the '8-1' dot in the sub-scanning direction accordingly occurs alternately in the main scanning direction. There is an interval of 5 passes between the '3-5' dot and the '8-1' dot. The '8-1' dot is thus created after an appreciably long time has elapsed since creation of the '3-5' dot. This means that these adjoining passes are discontinuous in time. In the conventional overlap printing with the nozzles #1 through #4, ink of the '3-4' dot is dried up before creation of the '8-1' dot. This enhances the possibility of a significant difference in density in this portion, compared with the other overlapped portions. This also enhances the possibility of the occurrence of banding due to accumulation of errors of sheet feeding.

The arrangement of this embodiment, on the other hand, creates dots with the $5^{th}$ nozzle #5, which is not selected in the conventional printing technique. This means that raster lines are formed by three: nozzles, that is, the $1^{th}$ nozzle, the $3^{rd}$ nozzle, and the $5^{th}$ nozzle, in the passes with the $5^{th}$ nozzle. This arrangement reduces the rate of creating the '8-1' dot at the position adjoining to the '3-4' dot in the sub-scanning direction to once every 6 columns, that is, to one third of the rate in the conventional overlap printing. In this printing technique, a '2-5' dot or a '5-3' dot is created, instead of the '8-1' dot. This reduces the density difference due to a significant time interval between creation of adjoining dots and thereby effectively prevents the occurrence of banding in this portion. When there is accumulation of errors of sheet feeding in the sub-scanning direction, creation of the '5-3' dot between the '8-1' and '2-5' dots formed by the both end nozzles, which are more significantly affected by the accumulated error, further prevents the occurrence of banding. Example with the number of nozzles N=7:

FIG. 16 shows another example, in which the present invention is applied to the overlap printing. The example of FIG. 16 uses the print head with a nozzle array of seven nozzles (#1 through #7), which are arranged at the intervals of 2 dot pitch (k=2) in the sub-scanning direction. In the case of this nozzle arrangement, the overlap printing technique is adopted to feed the printing medium by the pitch of 3 dots in the sub-scanning direction after each pass that carries out printing with six nozzles.

The procedure selects six nozzles (#1 through #6) out of the nozzle array and feeds the printing medium by the pitch of 3 dots in the sub-scanning direction after each pass that carries out printing in the main scanning direction with these selected nozzles. In the example of FIG. 16, 12 passes are carried out to form a pattern of 46 dots in the sub-scanning direction. The arrangement of this embodiment uses the nozzle #7, which is not used in the process of overlap printing, among the nozzle array and drives the nozzles #7 in each pass.

FIG. 17 shows an example of dot creation attained by 2 steps of these 12 passes. In this case, dots are printed at the positions defined as '1-7', '2-7', . . . , '11-7', and '12-7' by driving the nozzle #7. As shown in FIG. 17, actuation of the nozzle #7 causes the raster lines to be formed by three nozzles, that is, the $1^{st}$ nozzle #1, the $4^{th}$ nozzle #4, and the $7^{th}$ nozzle #7, in the passes with the nozzle #7. The other raster lines are formed by two nozzles, that is, the $2^{nd}$ nozzle #2 and the $5^{th}$ nozzle #5 or the $3^{rd}$ nozzle #3 and the $6^{th}$ nozzle #6.

In this embodiment, the maximum interval between the passes of the dots consecutively created in the sub-scanning direction is 3 passes even when the $7^{th}$ nozzle #7 is not driven. In the conventional overlap printing with six nozzles, the rate of creating the adjoining dots at the interval of 3 passes is once every 2 columns in the raster lines with the $1^{st}$ nozzle #1. In the arrangement of this embodiment, on the other hand, this rate is reduced to twice every 6 columns. Like the other examples discussed previously, this arrangement of the embodiment reduces the rate of creating the adjoining dots by the passes having a significantly large time interval between them and thereby lowers the probability of a significant difference in density due to a difference in degree of ink drying. Even when there is accumulation of errors of sheet feeding in the sub-scanning direction, the accumulated error is dispersed in such raster lines. This effectively prevents the occurrence of banding.

Example with varied amount of sub-scan feed:

This example uses a nozzle array having the total number of nozzles N equal to 4 and the dot pitch k equal to 4, where the feeding amount in the sub-scanning direction after each main scan is not fixed but is varied. In the example of FIG. 18, all the four nozzles are driven in each raster line, but the feeding amount in the sub-scanning direction after each main scan is alternately switched between the 2 dot pitch and the 5 dot pitch. In the example of FIG. 18, the $4^{th}$ nozzle #4 alone forms the $7^{th}$ raster line and the $14^{th}$ raster line in an effective printing range, but cooperates with the $1^{st}$ nozzle #1 in the $9^{th}$ raster line and the $16^{th}$ raster line. This means that the overlap printing technique is adopted for these raster lines.

In this example, the interval between the passes for creating the dots in the adjoining raster lines is not fixed but varied. The varied feeding amount in the sub-scanning direction effectively reduces the periodic effect of the error of sub-scan feed, which is ascribed to the constant amount of feed.

The present invention is not restricted to the above embodiments or applications, but there may be many other modifications, changes, and alterations without departing from the scope or spirit of the main characteristics of the present invention. In the above embodiment, the principle of the present invention is applied to the ink jet printer having nozzles for spouting ink as the dot-forming elements. The present invention is, however, also applicable to other printing apparatuses with similar dot-forming elements, such as a thermal printer and a thermal wax-transfer printer. Unlike the ink jet printer of the embodiment, the difference in degree of ink drying is not a significant problem in such printing apparatuses. There is, however, still the problem of the accumulated error of sheet feeding in these printing apparatuses. Application of the present invention accordingly prevents the occurrence of banding in these printing apparatuses.

The above examples refer to the nozzle arrays having the odd number of nozzles, like 5 nozzles or 7 nozzles. When each raster line is formed by two nozzles, there is always one remaining nozzle. The embodiment uses the remaining nozzle (for example, the nozzle #5 or the nozzle #7) and creates a dot adjoining the two dots formed by the passes having a significant time interval. In the case of an even number of nozzles, a remaining nozzle is present if the interlace conditions are not fulfilled. The procedure accordingly uses the remaining nozzle and creates a dot adjoining the two dots formed by the passes having a significant time interval. When the feeding amount L (dot pitch) in the sub-scanning direction is fixed at a constant value, the interlace conditions are that the number of nozzles N is equal to the value L and that the nozzle pitch k is an integer prime to the value N. In this case, the number of nozzles N represents the number of effective nozzles obtained as N=M/s, where M denotes the number of nozzles actually present, when each raster line is formed by s nozzles (where s is a positive integer and referred to as the number of repetition). For example, in the case of the number of nozzles M=8, the dot pitch k=6, and the feeding amount in the sub-scanning direction L=8, interlace printing causes overlap of dots in some raster lines. In this case, the procedure selects seven nozzles, that is, the $1^{st}$ through the $7^{th}$ nozzles, and implements interlace printing while the feeding amount L in the sub-scanning direction is fixed at the 7 dot pitch. In the raster lines where the $8^{th}$ nozzle overlaps another nozzle, the $8^{th}$ nozzle is driven to create a dot at the position where no dot has been created by this another nozzle driven in an intermittent manner or at the position where a dot has already been created by this another nozzle.

The above restrictions for implementing the interlace printing are relieved in the case where the feeding amount in the sub-scanning direction is varied in each main scan. There are, however, still some combinations of the number of nozzles with the nozzle pitch that do not attain the interlace printing. In this case, the procedure uses a remaining nozzle and creates a dot adjoining the two dots formed by the passes having a significant time interval.

The present invention is applicable not only to the printing apparatuses, such as printers, but to a variety of apparatuses with the printing apparatus incorporated therein, for example, a facsimile and a copying machine.

What is claimed is:

1. A printing apparatus that drives a print head to form a raster line, which comprises an array of dots arranged in one direction in a printing medium, and carries out a sub-scan, which feeds said printing medium relative to said print head in another direction that crosses the raster line whenever the raster line is formed, thereby printing an image, said printing apparatus comprising:

a dot-forming element array that is mounted on said print head and comprises N dot-forming elements (where N is a positive integer greater than 4) for creating dots on said printing medium, said N dot-forming elements being arranged at a k dot pitch, which corresponds to a minimum pitch between dots created on said printing medium, in the subs-canning direction;

a print head driving unit that drives said print head and causes required dot-forming elements in said dot-forming element array to create dots on said printing medium;

a sub-scan control unit that carries out the feed of said printing medium in the sub-scanning direction after each pass of raster creation, which drives said print head driving unit to form at least part of the raster line; and a dot creation control unit that selects n dot-forming elements (where n is a positive integer of less than N) among said dot-forming element array, makes a set of at least two dot-forming elements out of said selected dot-forming elements, and causes a raster line to be formed on said printing medium in each pass, said dot creation control unit causing a remaining dot-forming element other than said n dot-forming elements selected among said dot-forming element array and said made set of said dot-forming elements to create a dot adjoining to two dots, which are created by two passes having a significant time interval.

2. The printing apparatus in accordance with claim 1, wherein said dot creation control unit causes said remaining dot-forming element other than said selected dot-forming elements to create a dot adjoining to two dots, which are created by two passes that are discontinuous in time series.

3. The printing apparatus in accordance with claim 2, said printing apparatus further comprising:

a unit that drives said sub-scan control unit and said print head driving unit and causes part of said selected dot-forming elements to print dots in a subsequent pass, which partly overlap dots created in a preceding pass by said selected dot-forming elements.

4. The printing apparatus in accordance with claim 1, wherein a value n/s and the pitch k of said dot-forming elements is prime to each other (where s is the number of dot-forming elements that are used to form a raster line), when s dot-forming elements included in said n dot-forming elements aligned in the sub-scanning direction in said dot-forming element array are used to form one raster line, and wherein said sub-scan control unit feeds said printing medium by n/s dot pitch in the sub-scanning direction after each pass.

5. The printing apparatus in accordance with claim 1, wherein the two dots formed by the two passes having the significant time interval adjoin each other in the sub-scanning direction.

6. The printing apparatus in accordance with claim 1, wherein the two dots formed by the two passes having the significant time interval between them adjoin to each other in both the sub-scanning direction and the main scanning direction.

7. The printing apparatus in accordance with claim 1, wherein said dot creation control unit selects a different number of dot-forming elements among said dot-forming element array for part of a plurality of passes from a number of dot-forming elements selected for the other passes, and wherein said sub-scan control unit carries out the feed of said printing medium in the sub-scanning direction according to the number of selected dot-forming elements.

8. A method of driving a print head to form a raster line, which comprises an array of dots arranged in one direction of a printing medium, and carrying out a sub-scan, which feeds said printing medium relative to said print head in another direction that crosses the raster line whenever the raster line is formed, thereby printing an image, said method comprising the steps of:

driving said print head and causing a dot-forming element array mounted on said print head to create dots on said printing medium, wherein said dot-forming element array comprises N dot-forming elements (where N is a positive integer greater than 4) for creating dots on said printing medium and said N dot-forming elements are arranged at a k dot pitch, which corresponds to a minimum pitch between dots created on said printing medium, in the sub-scanning direction;

carrying out the feed of said printing medium in the sub-scanning direction after each pass of raster creation to form at least part of the raster line; and selecting n dot-forming elements (where n is a positive integer of less than N) among said dot-forming element array, making a set of at least two dot-forming elements out of said selected dot-forming elements, and causing a raster line to be formed on said printing medium in each pass, while causing a remaining dot-forming element other than said n dot-forming elements selected among said dot-forming element array and said made set of said dot-forming elements to create a dot adjoining to two dots, which are created by two passes having a significant time interval.

* * * * *